US005478077A

United States Patent [19]

Miyahara

[11] Patent Number: 5,478,077

[45] Date of Patent: Dec. 26, 1995

[54] OBJECT COLLISION POINT DETECTING APPARATUS

[75] Inventor: Takakazu Miyahara, Kaseda, Japan

[73] Assignee: Elm Inc., Kagoshima, Japan

[21] Appl. No.: 215,587

[22] Filed: Mar. 22, 1994

[30] Foreign Application Priority Data

| | | | |
|---|---|---|---|
| Mar. 31, 1993 | [JP] | Japan | 5-21649 U |
| Mar. 31, 1993 | [JP] | Japan | 5-098647 |
| Sep. 24, 1993 | [JP] | Japan | 5-261814 |
| Mar. 18, 1994 | [JP] | Japan | 6-074355 |

[51] Int. Cl.[6] ..... A63B 69/36

[52] U.S. Cl. ..... 273/185 R; 273/372

[58] Field of Search ..... 273/183.1, 181 R, 273/181 B, 181 C, 181 D, 181 E, 181 F, 181 H, 181 K, 182 R, 184 R, 185 R, 185 A, 372

[56] References Cited

U.S. PATENT DOCUMENTS

| | | | |
|---|---|---|---|
| 2,331,236 | 10/1943 | Schaefer | 273/181 C |
| 4,914,638 | 4/1990 | Milner | 367/90 |
| 5,056,791 | 10/1991 | Poillon et al. | 273/185 B |
| 5,062,641 | 11/1991 | Poillon et al. | 273/181 C |
| 5,221,082 | 6/1993 | Curchod | 273/185 A |

FOREIGN PATENT DOCUMENTS

| | | |
|---|---|---|
| 12580 | 6/1980 | European Pat. Off. . |
| 2654945 | 5/1991 | France . |
| 2682608 | 4/1993 | France . |
| 2254694 | 10/1992 | United Kingdom . |
| WO89/12483 | 12/1989 | WIPO . |
| WO91/04769 | 4/1991 | WIPO . |
| WO92/07632 | 5/1992 | WIPO . |

*Primary Examiner*—William H. Grieb
*Attorney, Agent, or Firm*—Oliff & Berridge

[57] ABSTRACT

An apparatus for use in training or playing in various shooting games, such as for a golf approach shot, baseball batting, or gun shooting. A target screen is provided opposite to a shooting point from which a ball or the like is shot out. Four microphones are provided at the circumference of the target screen to detect the collision sound, and another microphone is set at the shooting point to detect the shooting sound of the ball. The duration of flight of the ball, and the collision point on the screen, and the trajectory of the flying ball, are calculated by analyzing the detection time points of each microphone in a control part. The results, i.e., collision point on the target screen, flying trajectory of the ball, etc., are shown on a display unit.

16 Claims, 13 Drawing Sheets

OBJECT COLLISION POINT DETECTING APPARATUS

The present invention relates to an apparatus which can be used as a shooting training and/or game apparatus for golf (especially suited for an approach shot) or any other sports.

BACKGROUND OF THE INVENTION

Techniques required for a golf game consist of a driving shot, an approach shot and a putting shot. The driving shot is to drive a ball as far as possible in a desired direction. An approach shot is to shoot the ball more precisely in the direction and in the distance. And a putting shot is to put the ball into the hole on a green. It is generally said that the number of total shots of an average golf player is almost equally shared among the driving shot, approach shot, and putting shot. Therefore, these techniques have to be evenly practiced for improving the golf score.

Among these techniques, the driving shot can be practiced at any golf practicing range (or a driving-shot training field). The putting can be also practiced at a putting training field which is often attached to such driving-shot training field, or easily practiced with a simple putting mat on a house backyard. In an approach shot, the player is required to adjust his/her hitting power to control the flight of the ball (in distance and in direction) at less than the maximum drivable distance (typically less than 100 m) of the club used. Thus an approach shot can not be practiced at the same field as for the putting shot practice. The driving-shot practicing fields are generally designed mainly to practice the driving shot techniques, and are not suited for the exercise of the approach shot which is required to precisely check the destination of a ball shot in a relatively short distance. Further, there is hardly any golf practicing field allowing a practice in a situation where the altitude difference between the shooting point and a green (which usually exists in actual golf courses) is simulated.

Though various small sized apparatuses have been proposed so far, most of golf practice apparatuses available for home use are designed mainly for learning a shooting form or a swing practice. Except for expensive apparatuses for commercial use, there are few practicing apparatuses with which an actual ball can be shot, which requires a broad area to settle tall and long pipes and large nets.

One of the most important thing in an approach shot for the player is to know exactly where the shot ball goes. Prior art shooting machines could not tell the player the exact course of the flight of the shot ball. The problem is general in baseball batting machines, pitching machines, amusement gun shooting machines, etc.

SUMMARY OF THE INVENTION

An object of the present invention is therefore to overcome the above described problems and provide an apparatus for detecting an exact collision point of a flying object on a target, giving effective and pleasant shooting practicing machines. The present invention provides an apparatus applicable not only to the golf practice, but also to trainings for shooting, throwing, and playing in various games such as batting and pitching of baseball, and shooting with a sportive gun.

According to the present invention, an apparatus for detecting a collision point of an object in a detection area includes the following elements:

a) at least three sets of collision sound detectors or microphones located on a circumference of the detection area, wherein the at least three detectors must not be aligned on a line; and b) calculating circuit for calculating the collision point in the detection area based on the time points at which a collision sound of the object is detected by the at least three sets of collision sound detectors.

The collision point detecting apparatus may further include the following elements.

d) projection time detector (either a sound sensor or a photo sensor can be used) for detecting the time point of projection of the object from a predetermined projection point; and e) second calculating circuit for calculating a traveling time length from the time point when the object is projected from the predetermined projection point to the time point when the object collides against the detection area, based on the time points at which the collision sound is detected by the at least three sets of collision sound detectors and the projection time point detected by the projection time detector, and for calculating an orbit of the object until the object collides with another object or against the detection area and a virtual orbit after the object collides with the other object or against the detection area using the traveling time length and the collision point calculated by the calculating circuit.

The collision point detecting apparatus may further comprise the following elements.

f) ambient temperature sensor, and g) sound speed calculating circuit for calculating the sound speed based on the measured ambient temperature.

In this apparatus, the calculating means calculates the collision point using the calculated sound speed and the time points at which the collision sound is detected by the at least three sets of the collision sound detectors.

In the object collision point detector according to the present invention, when an object collides with another object in the detection area (said another object may be the ground, sheet, or water surface as well as a small body), each of the collision sound detectors detects the collision sound produced in the collision. The calculating means determines the location of the collision point in the detection area based on the time points (collision sound detecting time) when each collision sound detector detects the collision sound. In this calculation, a point where the object collides in the detection area (object collision point) is calculated in the similar manner as in the determination of the seismic center of an earthquake.

When the projection time detector is used, the spacial relationship between the projection point and the collision sound detectors is known. Thus, the orbit of the object after projection can be determined by the traveling time of the object from the projection to the collision and the position of the collision point in the collision detection area. Since the shape of the orbit has nothing to do with the collision, the virtual orbit after the collision can be also calculated assuming as if the object continues to move without collision. The second calculating means is provided to perform this calculation.

Other detailed features of the present invention and an application to a shooting training or amusement machine are described in the following description of preferred embodiments.

DETAILED DESCRIPTION OF PREFERRED EMBODIMENTS

Figure 1:
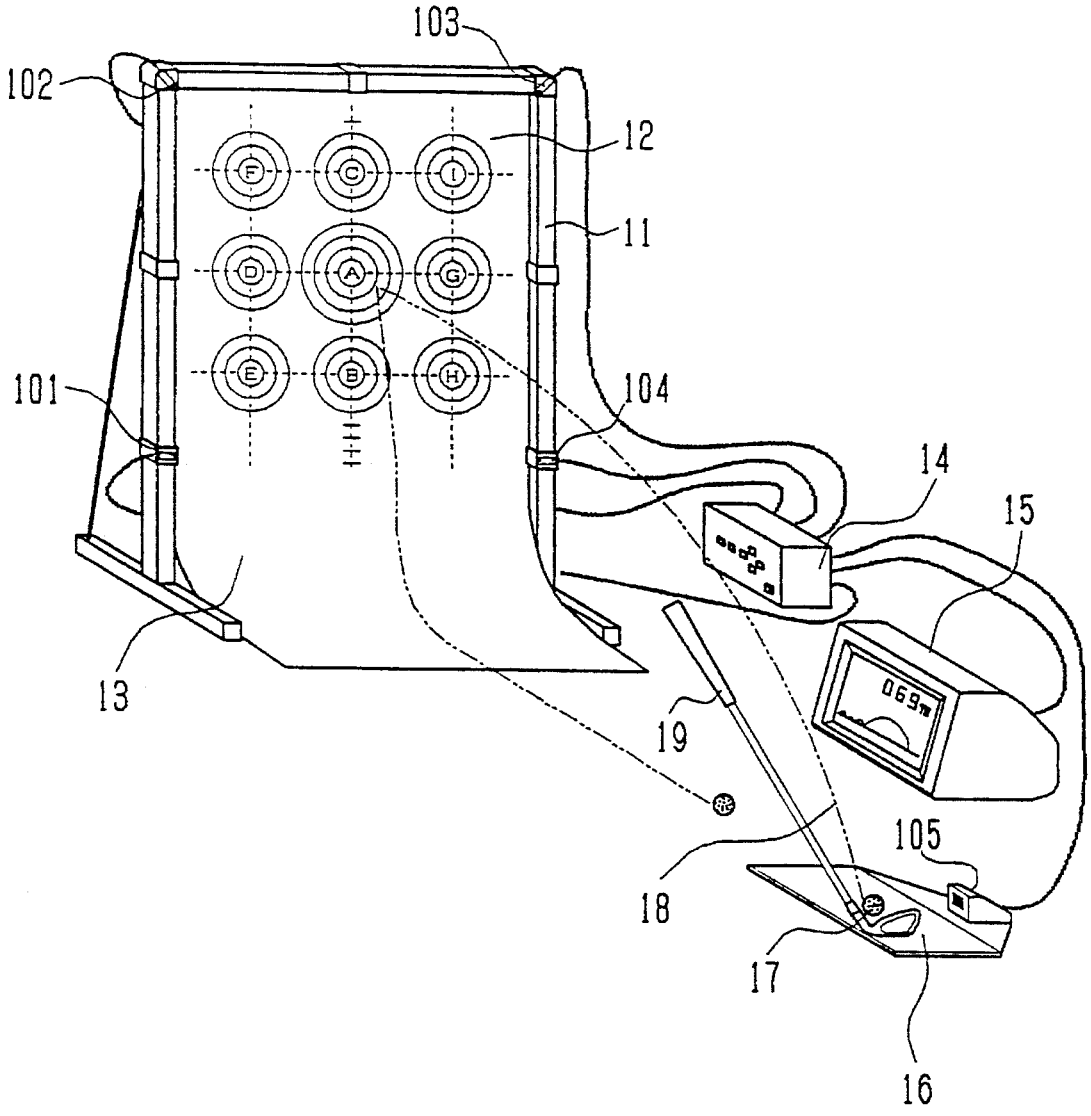
FIG. 1 is a general view illustrating an embodiment of a golf training apparatus according to the present invention for a golf approach shot.

FIG. 1 shows a general view of an embodiment of a training apparatus for a golf approach shot according to the present invention (first embodiment). In the apparatus of this embodiment, a nearly square frame 11 with a sheet 12 stretched thereon is used as a target screen. The sheet may be made of cloth, resin, or composite material. Reinforcement threads or reinforcement net such as metal thread, glass fiber thread, carbon fiber thread or the like may be used in the sheet 12. The dimension of the screen is preferably about 1–2 m in the side length. A drawn rod, drawn pipe Or seam pipe made of steel or aluminum can be used for the frame 11 (a lightweight aluminum pipe may be most suitable for handling convenience). By suitably adjusting the material of the sheet 12 and/or the tension, almost the entire kinetic energy of a colliding ball 17 is absorbed by the target sheet 12, whereby the forward motion of the ball 17 is stopped and the ball 17 falls just below the sheet.

Figure 8:
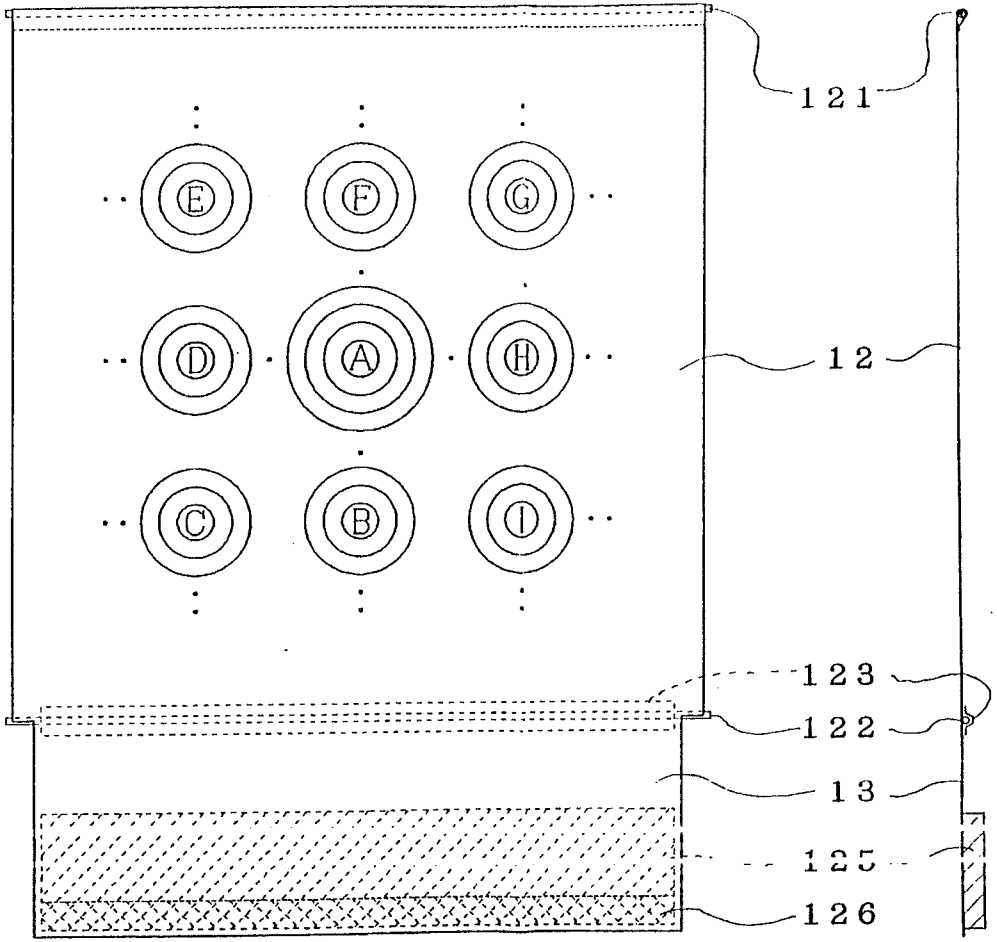
FIG. 8 is the front (left) and side (right) views of the target screen of an embodiment of the golf training apparatus for an approach shot.

An exemplary configuration of the sheet 12 and frame 11 is described in detail with reference to FIGS. 8–11. As shown in FIG. 8, the top end of the sheet 12 is turned down and joined (stitched or adhered) in the entire transverse length to form a tunnel to insert an upper bar 121. The width of the lower part of the sheet 12 (a skirt part 13) is made smaller. At the boundary of the upper part of the sheet 12 and the skirt part 13 a tunnel (like that at the upper end) is formed extending in the transverse direction with the sheet 12 and a cloth piece 123 attached at the back of the sheet 12, in which a lower bar 122 is inserted. The back sheet can be made of any sheet material such as a plastic sheet or the like. The lower bar 122 slightly extends out of the sheet 12 and the skirt part 13. A sponge rubber 125 is fixed (bonded) on the back of the skirt part 13 only at its lower part 126.

Figure 9:
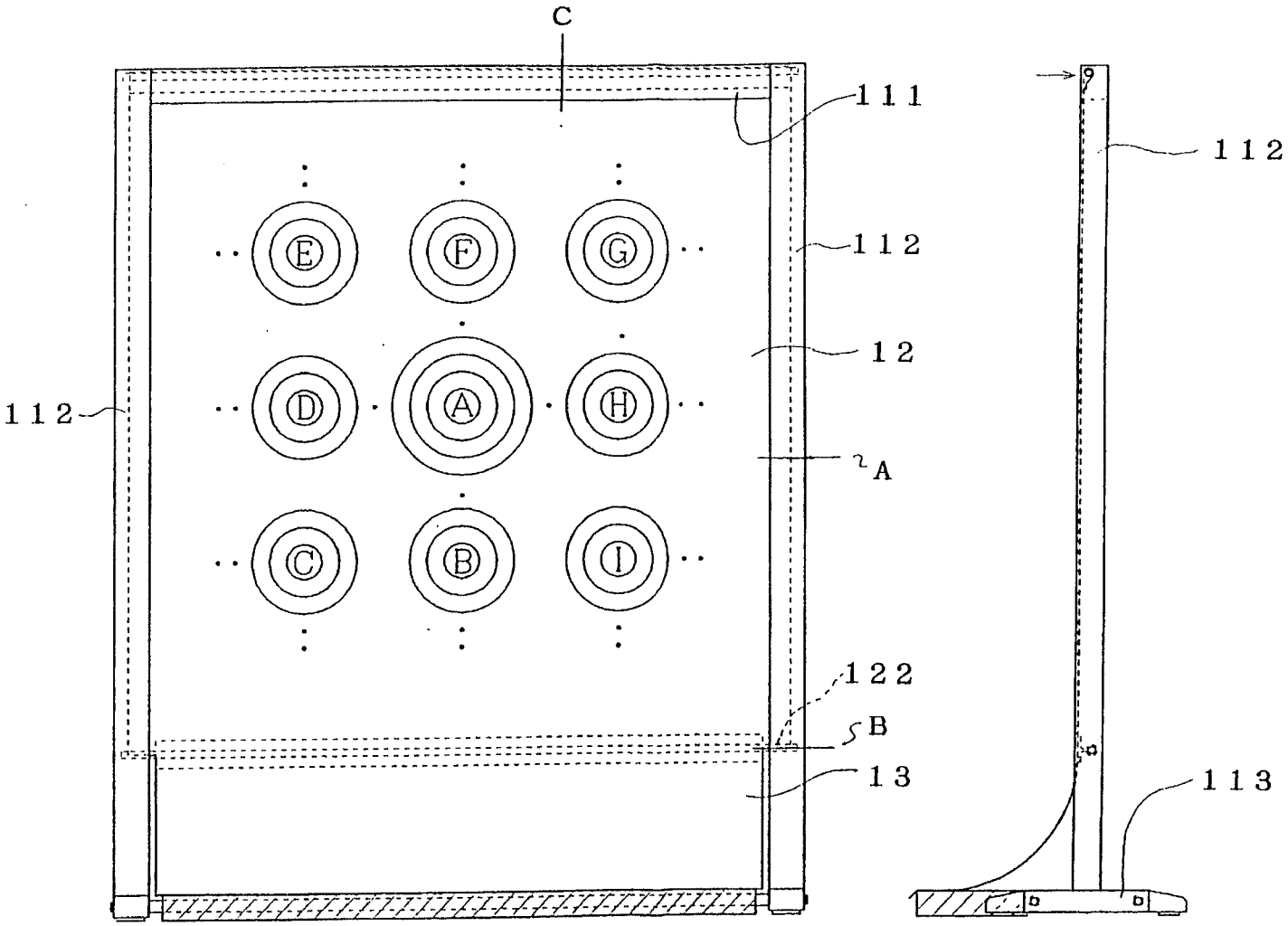
FIG. 9 is the front (left) and side (right) views of the target screen sheet set up at the frame.
Figure 11:
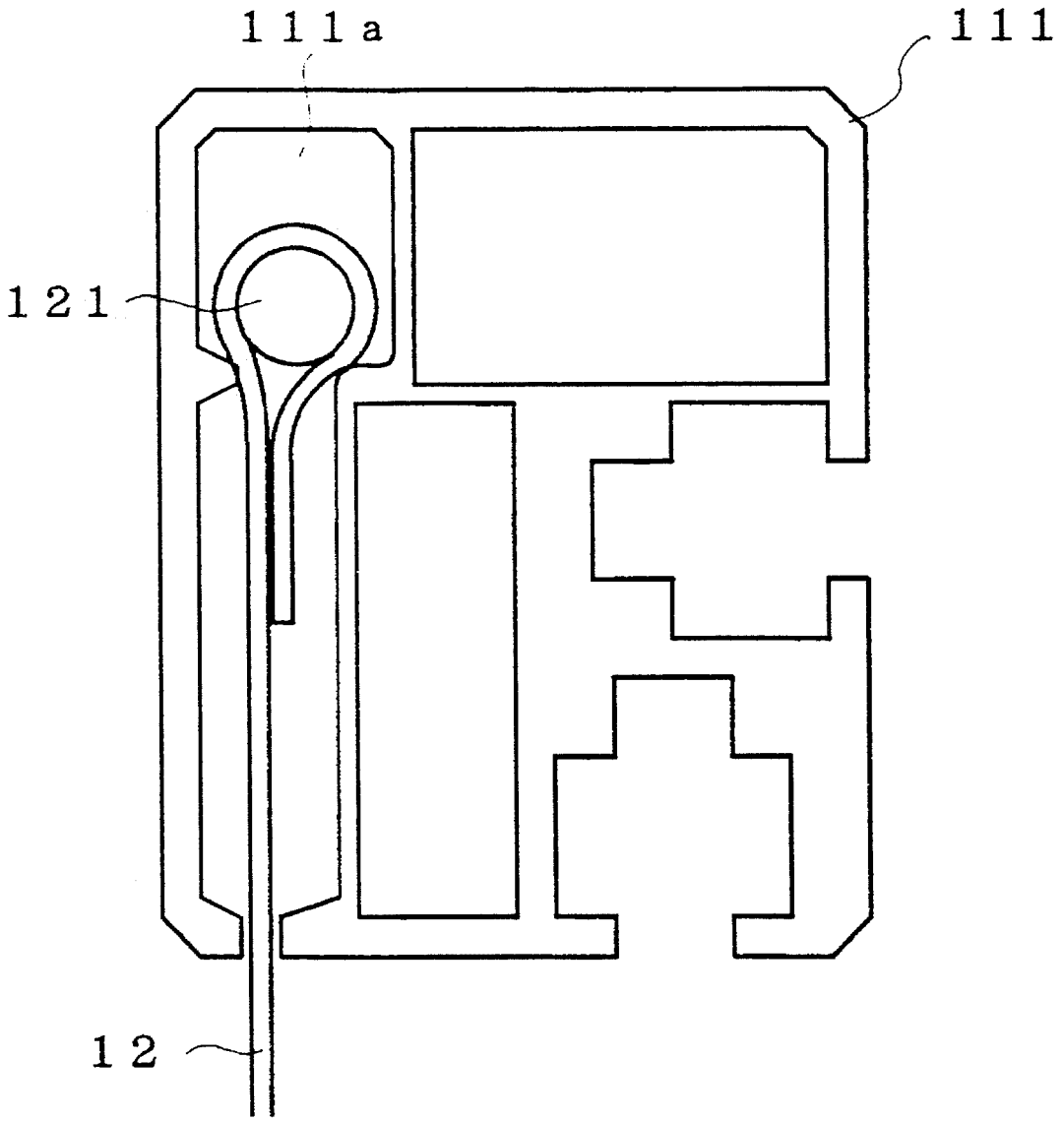
FIG. 11 is a cross-sectional view taken at the line C of FIG. 9.

As shown in FIG. 9, a frame is constructed of an upper beam 111, and left and right columns 112 and stands 113, each made of an aluminum drawn bar. FIG. 11 shows a cross-sectional view of the upper beam 111. The upper bar 121 fixed at the upper end of the sheet 12 is inserted in a space 111*a* (which is provided in the entire length of the upper beam 111), whereby the sheet 12 is suspended by the upper beam 111.

Figure 10A:
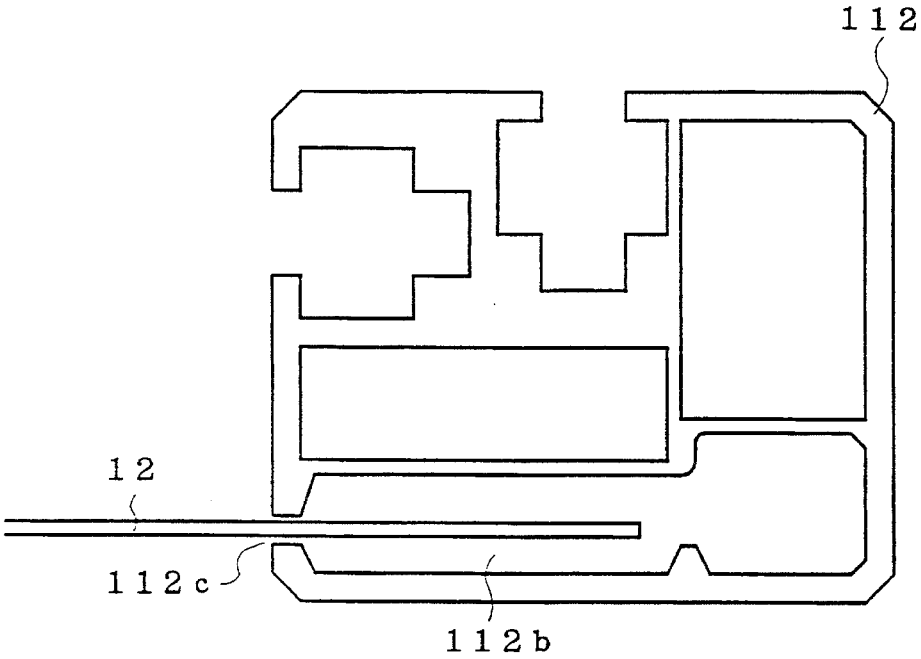
FIGS. 10A and 10B are cross-sectional views taken at the lines A and B of FIG. 9, respectively.
Figure 10B:
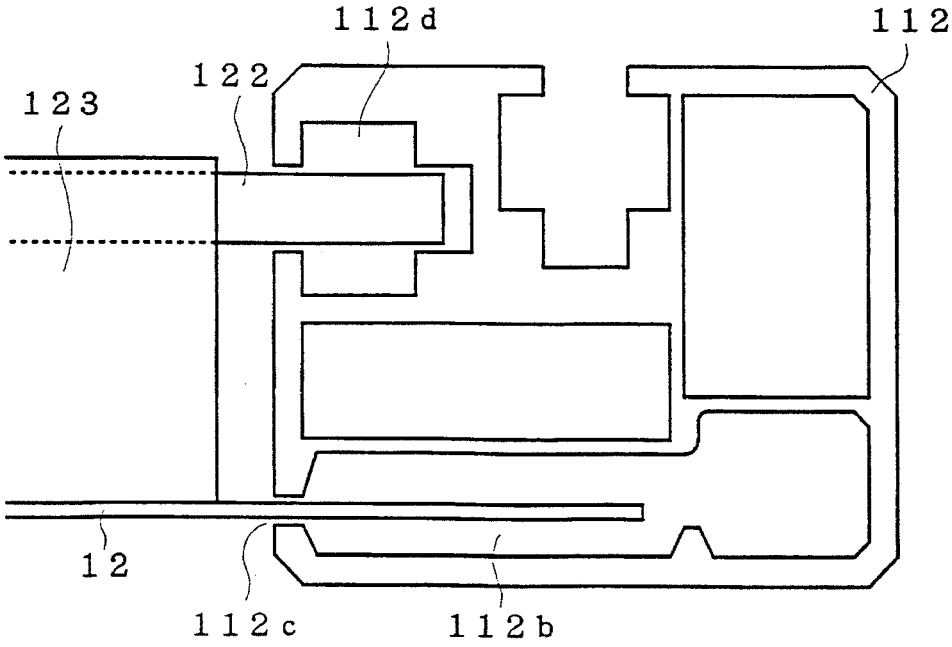

As shown in FIGS. 10A and 10B, in this embodiment, the two side columns 112 use the same member as the upper beam 111, and the side ends of the sheet 12 are inserted in the space 112*b* (slit) which is used for suspending the sheet 12 when the beam is used as an upper beam 111. The width of the entrance 112*c* of the slit 112*b* is made slightly larger than the thickness of the sheet 12, but the width of the interior of the slit 112*b* has a sufficient width such that the sheet 12 can undulate freely. Both ends of the lower bar 122 extending out of the sheet 12 and skirt part 13 are inserted in another space 112*d* (slot) provided inside of the column 112. The slot 112*d* is also provided in the entire length of the left and right columns 112, thereby allowing the vertical free movement of the lower bar 122.

Since the lower bar 122 can move upward along the slot 112*d* when a ball 17 collides against the sheet 12, the sheet 12 can bend backward, absorbing almost all the kinetic energy of the ball 17. Thus, the ball 17 falls approximately just below the sheet. Therefore, the player is protected from being hurt by a rebounding high speed ball. After the collision, the sheet 12 returns flat, thus allowing a precise aiming when a target pattern (score pattern) is printed on the sheet. When the ball 17 collides against the sheet, it may be worried that the side ends of the sheet 12 may be pulled centerward and might come out of the slit 112*b*. It will not happen, though, in the present embodiment. Since the entrance of the slit 112*b* is made narrow and the inside is made wide, the sheet 12 does not undulate in the narrow entrance 112*c* of the slit 112*b* but does undulate in the wide interior, thus the undulated extreme edge of the both sides of the sheet 12 functions as wedges preventing the sheet from coming out of the slit 112*b*. Consequently, the inside of the slit 112*b* is preferably sized in width greater than the undulating amplitude of the sheet 12.

Figure 7:
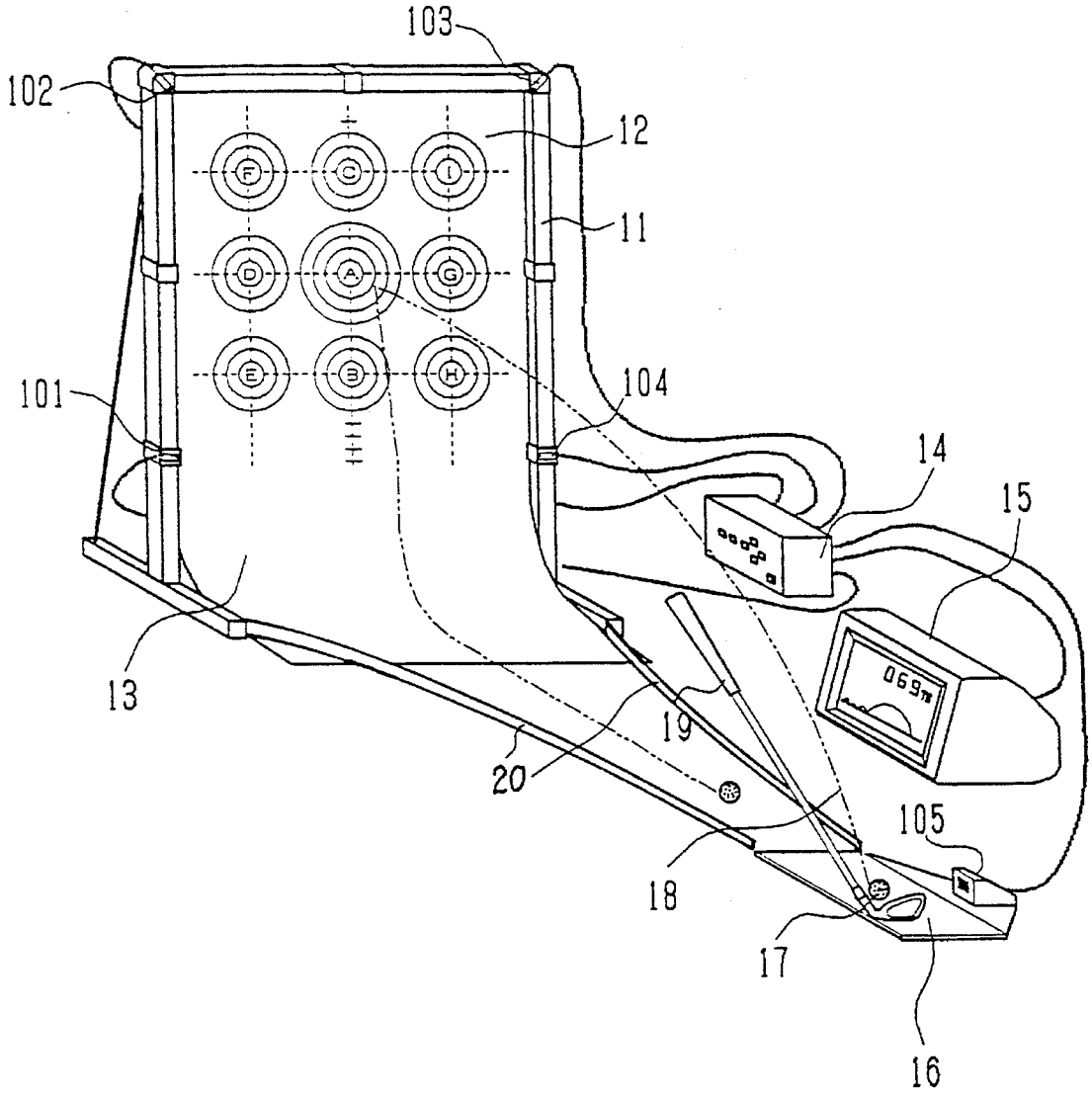
FIG. 7 is a structural view showing the outline of the golf training apparatus for an approach shot with a ball collecting frame provided between the screen and the shooting point.

When the ball 17 falls, the falling energy is absorbed by the sponge rubber 125 so that it does not rebound high. As shown in FIG. 1, the ball returns automatically toward the shooting point because the lower part 13 of the sheet 12 is configured to extend to the shooting place. Thus, balls shot into sheet 12 can be efficiently collected. Other mechanism for returning the balls may be separately provided, instead of only extending the lower part of the sheet 12 of the target screen. Another ball collecting frame 20 as shown in FIG. 7 may be used, which becomes narrower towards the shooting point. By fixing the collecting frame 20 to the lower ends of the frame 11, the collecting frame 20 is securely fixed to the frame 11 and scattering of the balls 17 is prevented. The phantom lines 18 in FIGS. 1 and 7 show a trace of a ball 17 hit at the shooting point, colliding with the screen, and returning to the shooting point.

The detection of a ball collision point on the screen can be performed by using at least three oscillation detectors (sound detectors) similar to the detection of the seismic center of an earthquake. In the golf approach shot training apparatus of this embodiment, however, four microphones (101–104) are used to correct the change in the speed of sound. These four microphones are located at the four corners of the frame 11 respectively. The collision sound produced when a ball 17 collides against the sheet 12 of the screen travels through the air and arrives at the microphones. Each microphone 101–104 is connected with a control part 14, and the control part 14 determines the time points upon receipt of the signals of collision sound detected by each microphone 101–104.

Another microphone 105 is also provided at the shooting point where a mat 16 made of artificial turf or the like is laid, which detects the impact sound when a ball 17 is hit by a golf club 19. The detection signal is also sent to the control part 14 to determine the time point.

A display unit 15 such as a CRT, LCD or the like is connected to the control part 14, and results (judgements, scores, indications or the like which will be described later) produced by analyzing the detected signals in various ways by the control part 14 are displayed on the screen of the unit 15, so that the player can see the results immediately after his/her shot.

Figure 2:
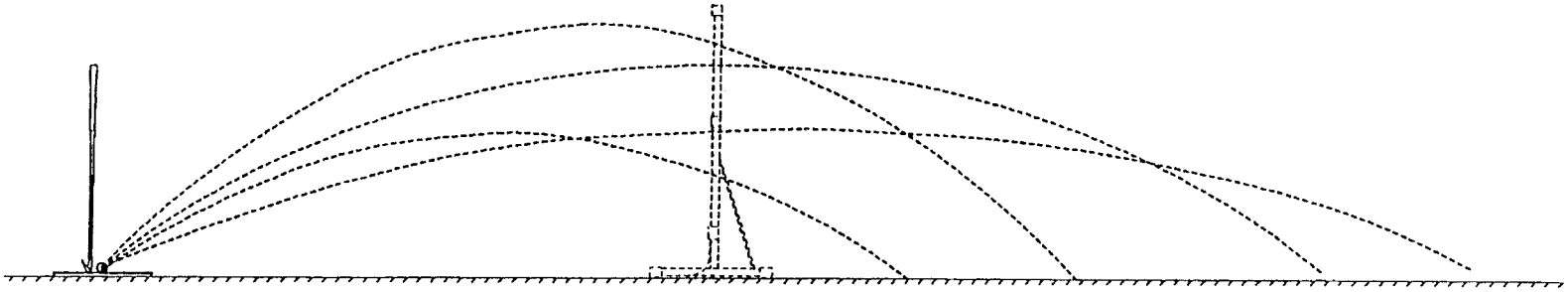
FIG. 2 is a schematic illustration showing a relationship among various orbits of balls and the collision points and angles against the target screen.

FIG. 2 shows various trajectories of a shot ball. A trajectory of a ball changes depending on a club used or how the ball is hit. As shown in this drawing, the flight distance of the ball can not be determined simply by the height at which the ball collides against the target screen, since the flight distance varies depending on the initial angle and initial speed. Thus in the golf approach shot training apparatus of the embodiment, a trajectory until the ball 17 collides against the screen 12 is calculated based on the coordinates of the ball colliding point on the screen and the time length from the time point when the ball is hit to the time point when it collides against the screen 12. Then the falling point, falling speed, and falling angle or other falling parameters of the ball are calculated. Based on the falling speed and the falling angle thus calculated, and further setting the energy of the ball at the fall and the rolling resistance on the ground, the ball travelling distance until stop from the falling point can be also calculated. Methods of these calculations will be described later.

Figure 3:
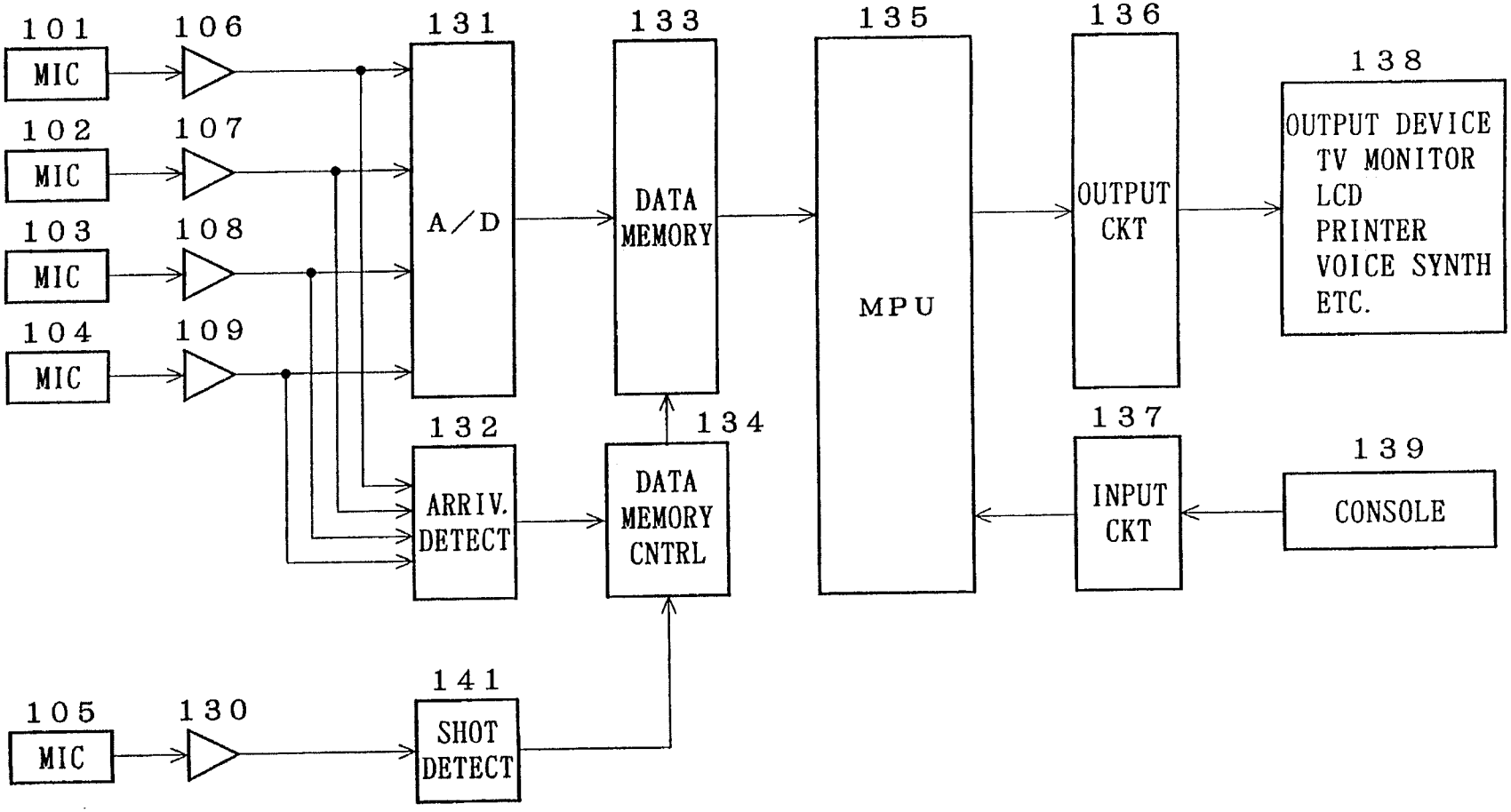
FIG. 3 is a block diagram showing the electric configuration of the embodiment of the golf training apparatus for an approach shot.

The electric structure of the control part 14 is shown in FIG. 3. Signals from the four microphones 101–104 (collision sound detecting means) pass through filters and amplifiers or the like 106–109 provided for each microphone. When the signals pass through the filters, elements such as ambient noises or the like are removed from the signals, and thus only the collision sound is extracted. The signals passing through the filters and amplifiers 106–109 are sent to two destinations. One is an arrival detection circuit 132, where the first of the detected signals of the collision sound is determined. The signal from the arrival detection circuit 132 is sent to a data memory 133 through a data memory control circuit 134. Similarly, the impact sound signal from the microphone 105 at the shooting point is also sent to a shooting detection circuit 141 through a filter and an amplifier or the like 130, where the ball shooting is detected and the detected signal is sent to the data memory control circuit 134. Signals from the four microphones 101–104 fare also sent to an A/D converter 131, where the signals detected by the four microphones 101–104 are independently A/D converted and written in the data memory 133 only within a certain period of time just before and after the ball 17 arrives based on a signal from the data memory control circuit 134.

Data sets of the collision sounds from the four microphones 101–104 are read out by an MPU circuit (which includes a microprocessor, ROM, RAM, oscillation circuit, decoder or the like) 135, and pre-processed to determine the exact time point of arrival of the collision sound to the four microphones 101–104 from the complicated oscillating waveform of the collision sound. After the time points are determined, the MPU circuit performs various calculations to determine the collision point on the target screen and the trajectory of the ball 17 or the like. After the calculations, the MPU circuit 135 sends the calculated results (evaluation, scores or the like) to an output circuit 136, which outputs the results to various output devices 138 such as a CRT monitor, LCD monitor, a printer, a voice synthesizer or the like, to let the player know the results. Various keys and switches 139 are provided on a casing of the control part 14, so that the player can select various modes and give input data. The input commands are sent to the MPU circuit 135 through an input circuit 137.

A method of calculating the collision point of the ball 17 on the target screen 12, and a calculation method of correcting the change in the sound speed according to the change in the temperature of the medium (air in this case) are described. It is assumed that the size of a side of the target screen is unity and resistance against flight of the ball 17 in the air is neglected for simplicity.

Detection of the ball collision point on the target screen

Figure 4:
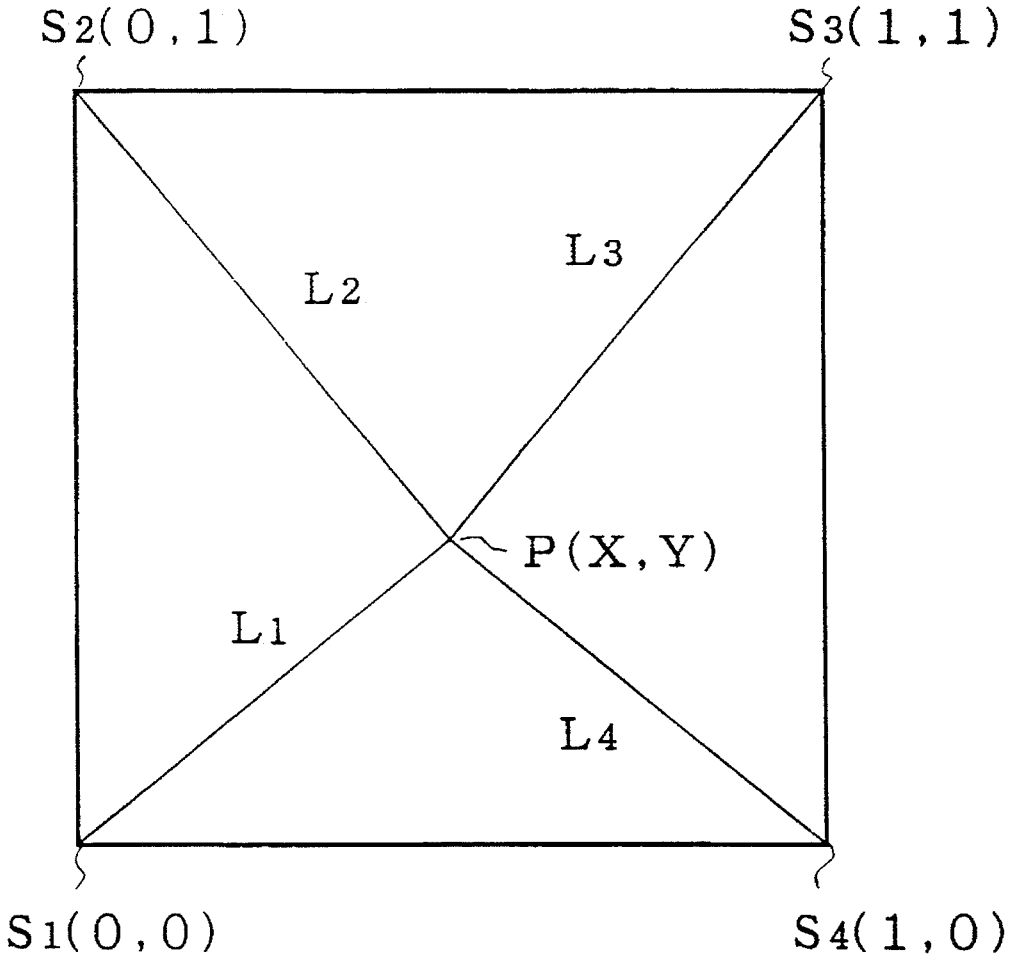
FIG. 4 is a schematic illustration showing a relationship between the collision point of a ball on the screen and points of microphones positioned at the circumference (in the first embodiment)

As shown in FIG. 4, the coordinates of the four corners of the square target screen 12 are provided as S1(0,0), S2(0,1), S3(1,1), S4(1,0), respectively, and the coordinate of the ball collision point is assumed to be P(X,Y). Distances from the point P to the four corners S1–S4 are provided as L1–L4 respectively. At the four corners, as above described, four microphones 101–104 are provided respectively as the collision sound detecting means. For the convenience of the later calculation, the time length from the point when a ball 17 collides against the screen 12 (at the point P) to the point when one of the four microphones 101–104 (which is nearest to the point P) detects the collision sound (shortest time, which can not be directly measured) is provided as t0, and the time lengths from the time point t0 to the time points when the collision sound arrives at the four microphones 101–104 are provided as t1, t2, t3, and t4 (where at least one of t1, t2, t3, or t4 is 0).

From the above described relation, the following equations hold in connection with L1–L4, $$L1^2 = X^2 + Y^2 = C^2 \cdot (t0 + t1)^2 \quad (1)$$
$$L2^2 = X^2 + (Y-1)^2 = C^2 \cdot (t0 + t2)^2 \quad (2)$$
$$L3^2 = (X-1)^2 + (Y-1)^2 = C^2 \cdot (t0 + t3)^2 \quad (3)$$
$$L4^2 = (X-1)^2 + Y^2 = C^2 \cdot (t0 + t4)^2 \quad (4)$$

where C is the speed of sound. By subtracting the equation (4) from the equation (1), X is obtained as follows.

$$X=\{C^2\cdot(t0+t1)^2-C^2\cdot(t0+t4)^2+1\}/2 \quad (5)$$

By subtracting the equation (3) from the equation (4), Y is obtained as follows.

$$Y=\{C^2\cdot(t0+t1)^2-C^2\cdot(t0+t2)^2+1\}/2 \quad (6)$$

The equations (5) and (6) include two unknown variables C (the sound speed) and t0. These values can be calculated as follows. From equations (1)–(4), $$(L1^2+L3^2)-(L2^2+L4^2)=0$$

Therefore, $$C^2\cdot\{2\cdot t0\cdot(t1-t2+t3-t4)+t1^2-t2^2+t3^2-t4^2\}=0 \quad (7)$$

Since $C^2>0$, $$2\cdot t0\cdot(t1-t2+t3-t4)+t1^2-t2^2+t3^2-t4^2=0 \quad (8)$$

As for the equation (8), the following two cases are possible: t1−t2+t3−t4=0 and t1−t2+t3−t4=0. Respective cases are explained separately.

I. In case of t1−t2+t3−t4=0

From the equation (8), $$t0=-(t1^2-t2^2+t3^2-t4^2)/\{2\cdot(t1-t2+t3-t4)\} \quad (9)$$

Putting t0+ti=Ti (i=1, 2, 3, 4) and substituting equations (5) and (6) for (1)

$$C^4\cdot\{T1^4+T3^4-2\cdot T2^2\cdot(T1^2-T2^2+T3^2)\}-2\cdot C^2\cdot(T1^2+T3^2)+2=0 \quad (10)$$

Using $a=T1^4+T3^4-2\cdot T2^2\cdot(T1^2-T2^2+T3^2)$ and $b=-(T1^2+T3^2)$, the equation (10) is rewritten to the following quadratic equation, $$a\cdot(C^2)^2+2\cdot b\cdot C^2+2=0 \quad (101)$$

noting $C^2>0$, Ti>0, the solution of $C^2$ of the quadratic equation (101) is $$C^2=\{-b-(b^2-2\cdot a)^{1/2}\}/a$$

Therefore, $$C^2=[(T1^2+T3^2)-\{(T1^2+T3^2)^2-2\cdot(T1^4+T3^4-2\cdot T2^2\cdot(T1^2-T2^2+T3^2))\}^{1/2}]/\{T1^4+T3^4-2\cdot T2^2\cdot(T1^2-T2^2+T3^2)\} \quad (11)$$

Since Ti is proportional to the distance Li between P and Si, similarly to the above equation (7), the following relation is obtained, $$T1^2+T3^2=T2^2+T4^2$$

and the equation (11) can be rewritten as $$C^2=[-\{4\cdot(T1^2+T3^2)^2-(T1^2-T3^2)^2\}^{1/2}+T1^2+T3^2]/\{T1^4+T3^4-2\cdot T2^2\cdot T4^2\} \quad (12)$$

(where t1−t2+t3−t4≠0)

Consequently, the coordinates (X,Y) of the ball collision point on the target screen 12 are obtained by substituting t0 obtained from the equation (9) and $C^2$ from (12) to the equations (5) and (6).

II. In case of t1−t2+t3−t4=0 in equation (8)

In this case, either (t1=t2, t3=t4) or (t1=t4, t2=t3) is possible. The two cases are further separately explained.

II-1 In case of (t1=t2, t3=t4) and (t1=t4, t2=t3)

In this case, the collision point P exists on the straight line passing through the center of the target screen 12 in parallel to the X axis. The following equation holds (except the center point of the screen 12).

$$Y=0.5$$
$$L1^2=L2^2=X^2+(0.5)^2=C^2\cdot(t0+t1)^2 \quad (13)$$
$$L3^2=L4^2=(X-1)^2+(0.5)^2=C^2\cdot(t0+t4)^2 \quad (14)$$

There are four unknown variables now: C (the speed of sound), t0 (the length of the traveling time of the collision sound from the collision point P to the nearest corner Si), X, and Y (coordinates of the collision point P). It is impossible to obtain the four unknown variables from the above three equations. Thus, the sound speed C is assumed to be the value obtained in the above t1−t2+t3−t4=0, or the well-known standard sound speed at 25° C. can be used as the value of C (the sound speed). Then from the equations (13), (14), $$X=\pm\{4\cdot C^2\cdot(t0+t1)^2-1\}^{1/2}/2 \quad (15)$$

Since X is a real number and X>=0, the true answer of X is only $$X=+\{4\cdot C^2\cdot(t0+t1)^2-1\}^{1/2}/2$$

Substituting this into equation (13) and rewriting it, and equation $$4\cdot C\cdot t0^2\cdot\{C^2\cdot(t1-t4)^2-1\}+4\cdot C^2\cdot t0\cdot(t1-t4)\cdot\{C^2\cdot(t1-t4)^2-1\}+\{C^2\cdot(t1-t4)^2-1\}^2+4\cdot\{C^2\cdot(t1-t4)^2-1\}C^2\cdot t1\cdot t4+1=0$$

is obtained. Substituting $\{-C^2\cdot(t1-t4)^2+1\}=A$ is the above equation and solving for t0, the following equation is obtained, $$t0=\{-(t1+t4)+(A-1)^{1/2}/(C^2\cdot A)^{1/2}\}/2$$

By substituting this equation into equation (15), $$X=\{(1-A^2)^{1/2}+A^{1/2}\}/(2\cdot A^{1/2})$$

when t1−t4>0, and $$X=\{(1-A^2)^{1/2}+A^{1/2}\}/(2\cdot A^{1/2})$$

when t1−t4<0. As described above, Y=0.5.

II-2 In case of (t1=t4, t3=t2) and (t1=t3, t2=t4)

In this case, the collision point P exists on the line passing through the center of the target screen and in parallel with the Y-axis. By assuming C (the sound speed) to be a known variable as in the above case of II-1, the variables t0 and Y are given as follows (except a point on the center of the screen 12).

Putting $C^2\cdot(t1-t2)^2-1=A$, $$t0=\{-(t1+t2)+(A-1)^{1/2}/(C^2\cdot A)^{1/2}\}/2$$

When t1−t2>0, $$Y=\{(1-A^2)^{1/2}+A^{1/2}\}/(2\cdot A^{1/2})$$

and when t1−t2<0, $$Y=\{(1-A^2)^{1/2}-A^{1/2}\}/(2\cdot A^{1/2})$$

As described above, X=0.5.

II-3 On case of t1=t2=t3=t4

This means that the collision point P is at the center of the target screen 12. Thus,

X=0.5

Y=0.5

With the methods described above, the coordinate of the ball collision point P(X,Y) on the target screen 12 is obtainable for every case. By comparing the calculated coordinate P(X,Y) with that of the position of the target pattern (e.g., concentric circles) previously printed on the target screen 12, the position of the collision point in the target pattern (i.e., within the central high-point circle, or in another peripheral circle) can be determined. With an appropriate additional calculation, a score can be also made. These calculations are performed by the MPU circuit 135.

Providing that the first of the four microphones 101–104 detects the collision sound at a time point T00, the ball colliding time point T0 is given as $$T0=T00-t0$$

When the relations t1=t2=t3=t4 holds, t0 is given as below, using the value of C obtained in the case of t1−t2+t3−t4≠0 or the standard sound speed at 25° C.

$$T0=T00-2^{1/2}/(2\cdot C)$$

Calculation of the trajectory of a shot ball

Variables used in the following calculations are defined first as follows.

θ: initial angle of the ball;

Tf: time length from the time point when the ball is shot to the time point when it collides against the target screen;

L0: distance from the shooting point to the target screen;

X: coordinate value in the horizontal direction of the ball collision point P(X,Y) on the target screen;

Y: coordinate value in the vertical direction of the ball collision point P(X,Y) on the screen;

V0: initial speed of the ball;

T0: time point when the shot ball arrives at the screen (with the origin 0 when the ball is hit);

Ls: distance from the shooting point to the microphone for detecting the shooting time;

Hg: difference in the altitude between the shooting point and an expected falling point;

Ts: time point when the shooting sound is detected (with the origin 0 when the ball is shot);

g: the acceleration of gravity.

In the above variables, the distance L0 from the shooting point to the target screen may be measured by the player when the screen 12 and a mat at the shooting point are settled. It is preferable that several standard distances are predetermined in advance (e.g. with 50 cm intervals within the range of about 2–4 m), and the player is allowed to select the place of setting the mat 16 among one of the predetermined distances on his preference. The selected distance is given to the machine by simply pushing one of several buttons or by operating numeral keys. Further, a distance sensor may be used, which is settled at the shooting point to measure the distance to the screen 12, and the automatically measured distance data is sent to the control part.

From the equation of motion, the x, y coordinates (x for the horizontal distance from the hitting point and y for the altitude) of the flying ball at a time point t is given as follows.

$$x=(V0\cdot\cos\theta)\cdot t \tag{16}$$

$$y=(V0\cdot\sin\theta)\cdot t-g\cdot t^2/2 \tag{17}$$

The speed in x and y directions at time point t is also given as follows.

$$Vx=V0\cdot\cos\theta \tag{18}$$

$$Vy=V0\cdot\sin\theta-g\cdot t \tag{19}$$

The time of flight of the ball 17 tf is obtained from the time point ts when the hitting sound arrives at the microphone 105 at the shooting point, the distance Ls from the shooting point to the microphone 105, and the time point T0 when the ball 17 collides against the screen 12 as follows.

$$Tf=T0-Ts+Ls/C$$

Since the speed of the ball 17 is very slow compared to the sound speed, change in the sound speed (about 0.6 m/sec/°C.) according to the temperature change is neglected.

Next, if a ball 17 shot with the initial angle θ and the initial speed V0 arrives at the target screen 12 at the horizontal distance L0 away from the shooting point after the time of flight Tf, the following equation holds.

$$L0=V0\cdot Tf\cdot\cos\theta \tag{20}$$

Similarly, in the vertical direction, $$Y=(V0\cdot\sin\theta)\cdot Tf-g\cdot Tf^2/2 \tag{21}$$

From the equations (20), (21), the initial angle θ is calculated as follows.

$$\theta=a\tan\{(1/2)\cdot(2\cdot Y+g\cdot Tf^2)/L0\} \tag{22}$$

By putting the equation (22) into (20), the initial speed V0 is obtained from the flight time Tf of the ball 17 and Y (which is the height of the collision point P on the target screen 12 and has been obtained before).

$$V0=(1/2)\cdot\{4L0^2+4\cdot Y^2+4\cdot Y\cdot g\cdot Tf^2+g^2\cdot Tf^4\}^{1/2}/Tf \tag{23}$$

Then substituting equations (22) and (23) for the equation of motion in the vertical direction, the height H of the flight of the ball 17 is given as $$H=(T/2)\cdot(2\cdot Y-g\cdot Tf^2-g\cdot T\cdot Tf)/Tf$$

When the ball 17 falls onto the green having an altitude difference of Hg from the shooting point, H equals Hg. Thus, the flight time Ta is obtained as follows.

$$Ta=\{2\cdot Y+g\cdot T0^2+(4\cdot Y^2+4\cdot Y\cdot g\cdot T0^2+g^2\cdot T0^4-8\cdot g\cdot Hg\cdot T0^2)^{1/2}\}/(2\cdot g\cdot T0) \tag{24}$$

Putting Ta and the equations (22) and (23) obtained here in the equation of motion (16) in the horizontal direction, the flight distance Lf of the ball 17 is obtained as below, $$Lf=V0\cdot Ta\cdot\cos\theta \tag{25}$$

In order to calculate the maximum altitude of the flight of the ball 17, the time Tm when the speed Vy in the vertical direction becomes zero is calculated.

$$Vy=V0\cdot\sin\theta-g\cdot t$$

$$V0\cdot\sin\theta-Tm=0$$

$$Tm=(V0\cdot\sin\theta)/g$$

Putting these equations into the equation (21)

$$Ym=(V0^2\cdot\sin^2\theta)/(2\cdot g)$$

As described above, the trajectory of the ball 17 has been calculated completely. After completing the trajectory calculation, the MPU circuit 135 displays the trajectory on a display unit 15 or the like through an output circuit 136 as in FIG. 2. In this case, the target screen 12 is also shown on the display, and the virtual (virtual because actually the ball does not fly further) trajectory after colliding the screen is also displayed.

Calculation of the movement of the ball after landing

When a ball 17 actually falls on a green, it bounces several times and rolls on the turf of the green until it stops. Here the backspin speed of the ball 17 varies depending on which club or ball is used, or how the ball is hit. In addition to that, the rolling condition on the green varies depending on the falling point. Thus it is almost impossible to precisely calculate the bounds and rolling distance. It is possible, however, to simulate the movement of the ball after landing when appropriate values of the falling speed, falling angle, ball property factors, hardness of the green, and rolling resistance of the green or the like are given. An example of such calculation simulating the movement of a ball after landing is hereinafter described.

First the falling angle θf and the horizontal falling speed Vx are obtained. The tangent angel θt of a flying ball 17 can be given by the vertical element Vy and horizontal element Vx as follows.

$$\tan\theta t=Vy/Vx$$

Using the time length Ta until the ball 17 falls and the horizontal speed Vx (air resistance is neglected here, so that Vx equals to the initial speed V0), the falling angle θf is $$\tan\theta f=\{V0\cdot\sin\theta-g\cdot Ta\}/(V0\cdot\cos\theta)$$

$$\theta f=\mathrm{atan}\{\tan\theta-g\cdot Ta/(V0.\cos\theta)\}$$

If the ball 17 sinks into the green when it lands, a part of the kinetic energy is absorbed, the amount of the absorbed energy varies depending on the "hardness" of the green and the falling angle θf, or other parameters. Here the "hardness" of the green is represented by an energy absorption factor A. Actually, when the ball 17 lands on the green, it bounces a few times and rolls on the green until it stops. In this apparatus, the ball is assumed to start rolling immediately after landing, and the horizontal speed Vg at the beginning of the rolling is approximated by the following equation.

$$Vg=V0\cdot\cos\theta\cdot(\cos^2\theta f+A\cdot\sin^2\theta f)^{1/2} \quad (26)$$

Next, the rolling resistance R and the equation (25) are substituted for the equation of motion of a constantly negative-accelerated object to obtain the time length Tr until the rolling speed Vr becomes zero (or until the ball stops).

$$Vr=Vg-R\cdot Tr=0$$

$$Tr=Vg/R$$

Further, R and the equation (26) are substituted for the equation of motion expressing the travelling distance of a constantly negative-accelerated object, whereby a rolling distance Lr is given as $$Lr=Vg\cdot Tr-R\cdot Tr^2/2$$

Figure 5:
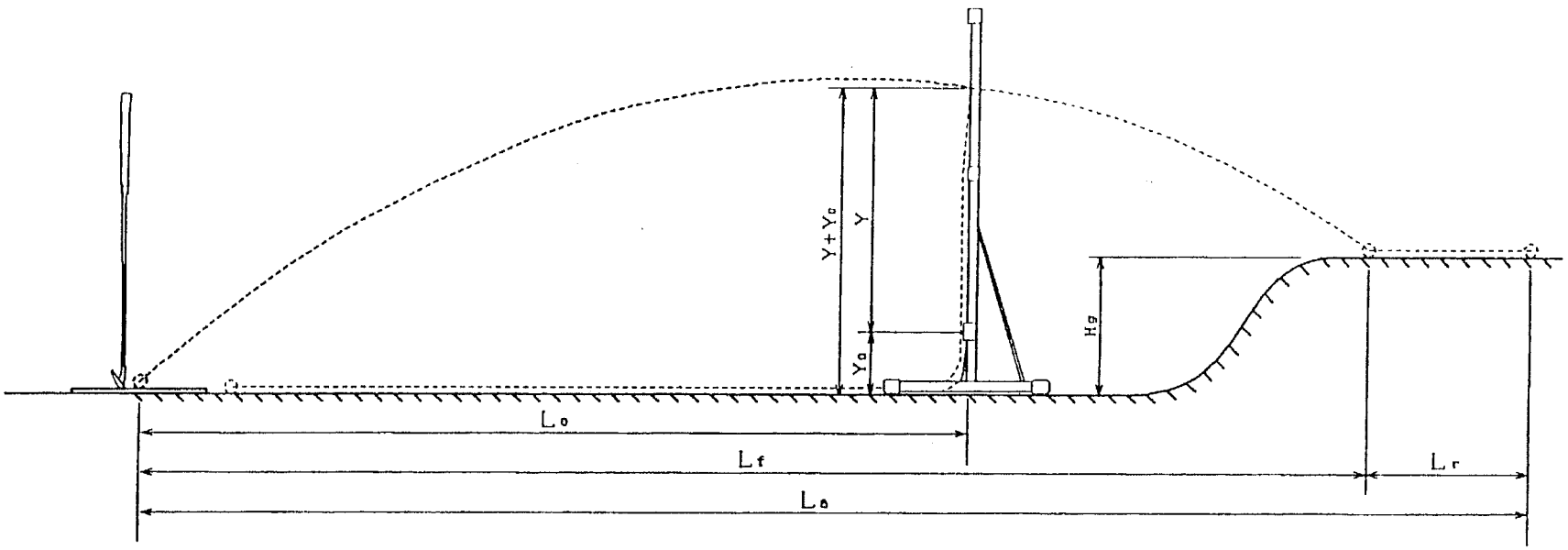
FIG. 5 is a schematic illustration showing the orbit with a difference in altitude between a shooting point and a green.

The above calculations are performed assuming that the origin (lower left corner S1) is at the same altitude as the shooting point. When using the apparatus of the present embodiment, it is more convenient to settle the target screen 12 at a level slightly higher than the shooting point. FIG. 5 shows a side view illustrating such a state. In this case, the height data used in the previous calculations must be the vertical point Y (at which the ball 17 collides) plus the elevation Y0 with which the target screen 12 is settled.

It is assumed in the equations previously described that a ball flies in the vertical plane including the shooting point and the center of the screen 12. Thus, when the trajectory of the ball 17 is horizontally off the center, the horizontal distance L01 from the shooting point to the collision point P on the screen 12 should be modified with $$L01=\{L0^2+(X-0.5)^2\}^{1/2}$$

to obtain the precise flying distance of the ball.

However, as a golf approach shot training apparatus, the flight course is more easily recognized by the players when the trajectory is expressed by way of the flying distance along the central line 61 (of the screen 12) and a deviation from the central line 61, and when falling point is expressed by way of the deviation from target point, rather than expressing the flight distance by a straight distance connecting between the shooting point and falling point. Therefore, in this training apparatus, the flight distance is expressed in Lf, the rolling distance is expressed in Lr, and the distance until the ball 17 stops is expressed in Lf+Lr.

Figure 6:
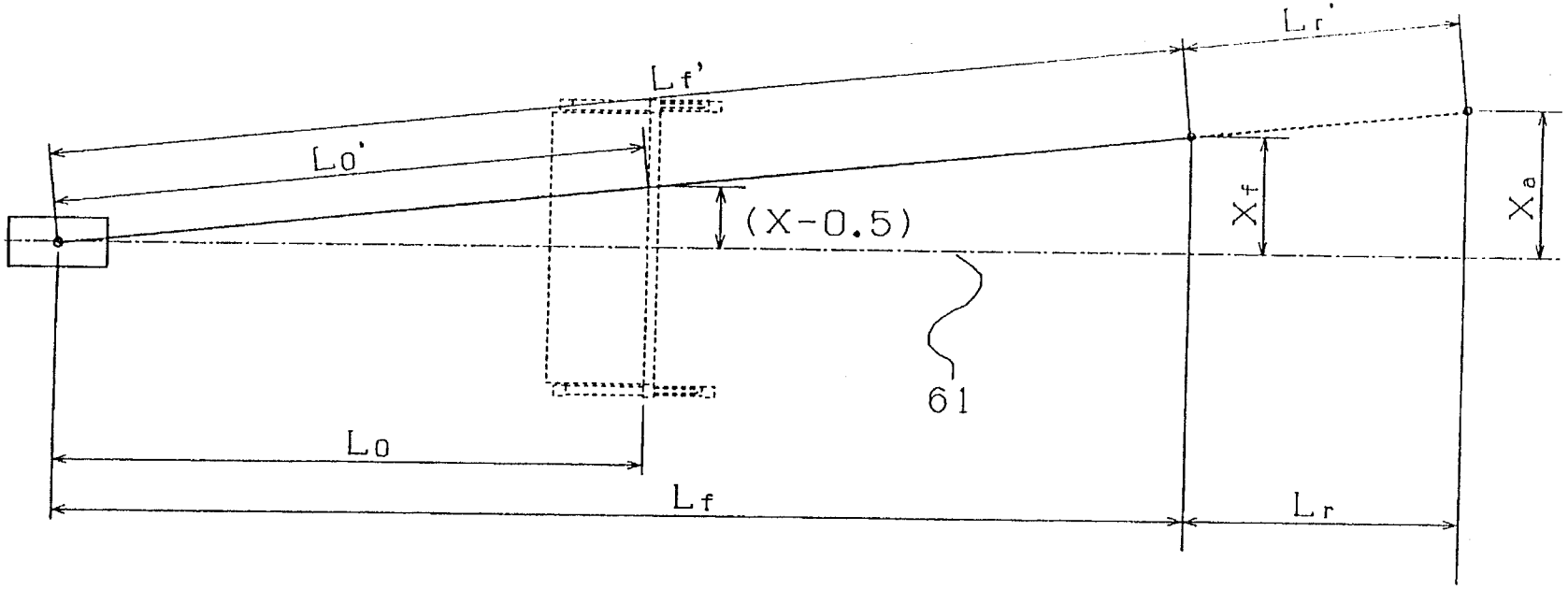
FIG. 6 is a schematic illustration showing an orbit when a ball is shot in a horizontally deviated direction.

The horizontal deviation distance Xf of the falling point of the ball from the center line can be expressed in the following relation from FIG. 6.

$$Lf/L0=Xf/(X-0.5)$$

Therefore, $$Xf=\{Lf\cdot(X-0.5)\}/L0$$

Similarly, the horizontal deviation distance Xa from the center line to the point where the ball 17 rolls and stops after landing is expressed as $$Xa=\{(Lf+Lr)\cdot(X-0.5)\}/L0$$

where Xa>0 means that the ball has deviated to the right, and Xa<0 means that then the ball has deviated to the left.

It is said that a daily practice such as swinging a club, even for a short time, is required to improve the golf skill. If, however such daily practice is monotonous, the player may get tired of doing this, and it will be hard to continue the practice. As described above, when this golf approach shot training apparatus is used, the player does not get tired of doing the daily practice, because various calculations are performed on data collected in one shot as described above and the calculation results are displayed in various interesting modes (e.g. flight trajectory of the ball is displayed on a display unit 15 as shown in FIG. 2, FIG. 5, or FIG. 6, and scores are shown based on comparing the collision point with the position of a target pattern printed on the target screen as shown in FIG. 1). In addition to this, because real golf balls 17 and clubs 16 can be used, the practice is very close to a real approach shot. Shot balls automatically return to the player, so that the player can shoot balls many times consecutively without fetching them, therefore, an efficient practice is achieved.

Another embodiment (second embodiment) of the golf approach shot training apparatus according to the present invention is now described. The golf approach shot training apparatus of the present embodiment has almost the same configuration as of the first embodiment described above shown in FIG. 1, and the electric configuration of the control part 14 is also almost the same as of the first embodiment in FIG. 3 (as will be described later, the control part 14 has a slight difference in the electric configuration depending on calculation methods for the collision point).

The present embodiment is different in the calculation method from the first embodiment. In the present embodiment, the calculating method for detecting collision point of a ball 17 on the target screen is different from the first embodiment. The calculation method according to the present embodiment is described with reference to FIGS. 12–14. It is assumed that microphones 101–104 are provided at the four corners of the screen and the air resistance against the ball is neglected to simplify the explanation.

Detection of the ball collision point on the target screen

Figure 13:
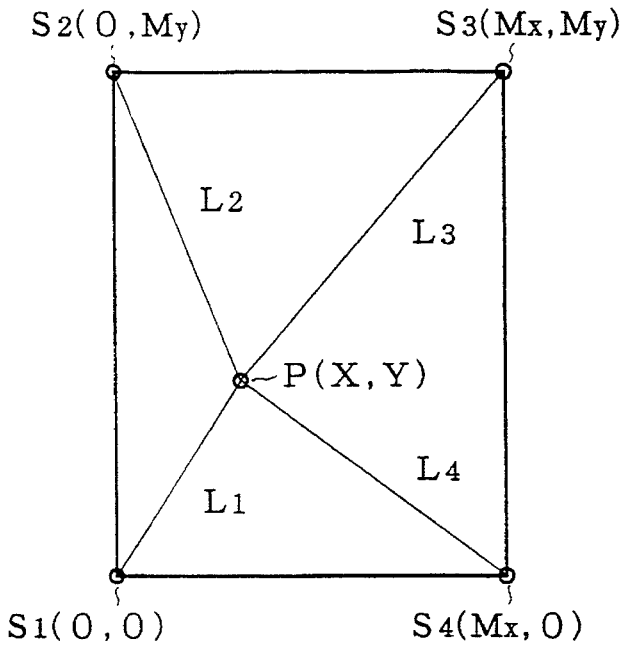
FIG. 13 is a schematic illustration showing a relationship between the collision point of the ball on the screen and points of microphones positioned at the circumference (in the second embodiment)

As shown in FIG. 13, the coordinates of the four corners on a rectangular target screen 12 are S1(0,0), S2(0,My), S3(Mx,My), and S4(Mx,0), respectively, and the coordinate of the collision point on the target screen is P(X,Y). Distances from the point P to the four corners S1–S4 are L1–L4, respectively. Microphones 101–104 (collision sound detecting means) are provided at the four corners in the same manner as in the first embodiment. The present apparatus measures the time points when a collision sound arrives at each microphone. The time points when the collision sound arrives at the microphones are ta1, ta2, ta3, and ta4, respectively.

The position of the collision point can be determined by at least three distances from the collision point to three microphones. Here the microphone 101 is taken as the reference microphone and other two microphones 102 and 104 neighboring the microphone 101 are utilized to calculate the collision point.

The time length from the time point when a ball 17 collides against a target screen 12 to the time point when the collision sound arrives at the microphone 101 ("collision sound arrival time") is provided as t0 (which is not directly measurable). The difference in the arrival time length of the collision sound between the microphones 101 and 102 is provided as t2, and similar difference in the time length between the microphones 101 and 104 is provided as t4. In this case, $$t2=ta2-ta1 \tag{27}$$

$$t4=ta4-ta1 \tag{28}$$

The sound speed C is necessary to convert the above time lengths t0, t2, and t4 into the distances on the target screen 12. The sound speed varies according to the air temperature T as, $$C=331.5+0.6\cdot T \tag{29}$$

The sound speed will be explained later again.

The distance L0 (=L1) from the collision point P to the microphone 101, the difference Lt2 between L0 and L2, and the difference Lt4 between L0 and L4 are calculated with the above sound speed C as follows.

$$L0=t0\cdot C \tag{30}$$

$$Lt2=t2\cdot C \tag{31}$$

$$Lt4=t4\cdot C \tag{32}$$

The collision point P(X,Y) in FIG. 13 and the above equations (30), (31), and (32) have the following relationship.

$$X^2+Y^2=L0^2 \tag{33}$$

$$(Mx-X)^2+Y^2=(L0+Lt4)^2 \tag{34}$$

$$X^2+(My-Y)^2=(L0+1t2)^2 \tag{35}$$

X, Y, and L0 can be obtained from the above three equations as follows.

$$X=(Mx^2-2\cdot L0\cdot Lt4+Lt4^2)/(2\cdot Mx) \tag{36}$$

$$Y=(My^2-2\cdot L0\cdot Lt2+Lt2^2)/(2\cdot My) \tag{37}$$

$$L0=[\{B4\cdot B2\cdot(B2+B4+2\cdot Lt2\cdot Lt4)\}^{1/2}-(B4\cdot Lt4\cdot My^2+B2\cdot Lt2\cdot Mx^2)]/\{2\cdot(B2\cdot Mx^2+B4\cdot My^2-Mx\cdot My)\} \tag{38}$$

or $$L0=[-\{B4\cdot B2\cdot(B2+B4+2\cdot Lt2\cdot Lt4)\}^{1/2}-(B4\cdot Lt4\cdot My^2+B2\cdot Lt2\cdot Mx^2)]/\{2\cdot(B2\cdot Mx^2+B4\cdot My^2-Mx\cdot My)\} \tag{39}$$

where $B2=My^2-Lt2^2$ $B4=Mx^2-Lt4^2$

Here L0 has two solutions. If the collision point P is within the rectangle of S1, S2, S3, and S4, the equation (38) gives the distance between the collision point P and S1. The other case will be described later in detail.

Methods for improving precision and reliability

The number of measured values (collision sound arrival time points) used in the above calculations are three: tal, ta2, and ta4. The use of another measured value ta3 renders four answers to the collision point P(X,Y) since four other similar calculations can be made. By obtaining the average value of these four answers, an error from the true value can be reduced and the precision is improved.

In addition to that, an erroneous detection or calculation process can be made apparent if any of the differences between any two of the four answers is out of a predetermined range. This improves the reliability of the detection and calculation.

Measurement of the sound speed C

As described above, the sound speed is necessary to calculate the collision point of a ball 17. When high precision is not required or the air temperature is constant, the collision point can be calculated using a predetermined sound speed. When, however, a change in temperature is large, or high accuracy is required, the sound speed or the temperature need to be measured. In order to obtain the sound speed, two methods are now described. One is to use a temperature sensor such as a thermistor and the other is to calculate from the data obtained from at least 4 microphones.

[1] Method with a temperature sensor such as a thermistor

Figure 12:
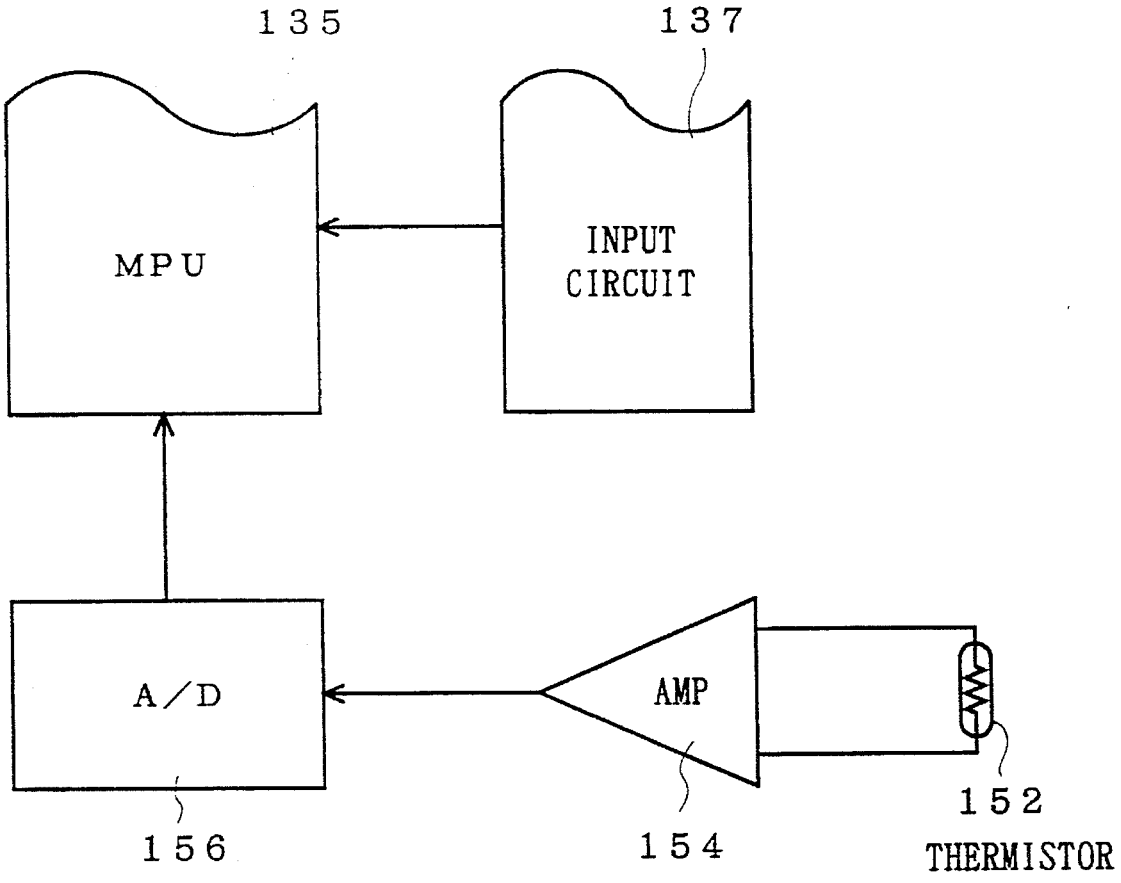
FIG. 12 is an electric diagram showing a temperature detection circuit with a temperature sensor used to obtain the speed of sound.

In this method, the air temperature T is measured by adding the temperature detection circuit as shown in FIG. 12 to the electric configuration of the control part 14 shown in FIG. 3. In this case, the output signal of the thermistor 152 detecting the temperature is amplified by an amplifier 154, and then input into the A/D converter 156. The value of the signal input into the A/D converter 156 is converted into a digital signal, and then sent to the MPU circuit 135. The MPU circuit 135 calculates the sound speed C based on the temperature T as follows.

$$C=331.5+0.6\cdot T[\mathrm{m/sec}]$$

In the example of FIG. 12, the detection signal of the temperature T is converted by the A/D converter and then sent to the MPU circuit. Instead, various methods can be used such as: an analog signal is sent to the MPU circuit after voltage/frequency converted or voltage/pulse width converted. When an analog signal is input into the MPU circuit, the digital temperature value T can be obtained by measuring the frequency or the pulse width.

[2] Method of calculating from data obtained at least four microphones

Microphones are located at the four corners S1-S4 as shown in FIG. 13, in this case. The following equations are established from among the coordinate of the collision point P(X,Y) and the coordinates of the four corners S1(0,0), S2(0,My), S3(Mx,My), and S4(Mx,0) at which the four microphones are respectively located $$L1^2 = X^2 + Y^2 \tag{40}$$

$$L2^2 = X^2 + (Y - My)^2 \tag{41}$$

$$L3^2 = (X - Mx)^2 + (Y - My)^2 \tag{42}$$

$$L4^2 = (X - Mx)^2 + Y^2 \tag{43}$$

where

Li: distance from the collision point to each microphone (i=1–4)

These are rewritten as $$L1^2 = C^2 \cdot (t0 + t1)^2 \tag{44}$$

$$L2^2 = C^2 \cdot (t0 + t2)^2 \tag{45}$$

$$L3^2 = C^2 \cdot (t0 + t3)^2 \tag{46}$$

$$L4^2 = C^2 \cdot (t0 + t4)^2 \tag{47}$$

where t0: time length from the time point when the collision sound is generated to the time point when the collision sound arrives at the reference microphone ti: time interval between the time point when the reference microphone detects the collision sound and the time point when another microphone detects the collision sound From the equations (40)–(47)

$$2 \cdot t0 \cdot (t1 - t2 + t3 - t4) + t1^2 - t2^2 + t3^2 - t4^2 = 0 \tag{48}$$

$$t0 = -(t1^2 - t2^2 + t3^2 - t4^2)/\{2 \cdot (t1 - t2 + t3 - t4)\}$$

in order to simplify this equation, the following substitutions are made.

T1=t0+t1

T2=t0+t2

T3=t0+t3

T4=tO+t4

From the equations (40)–(47)

$$\{(T4^2 - 1T1^2) \cdot Mx^2 - (T2^2 - T1^2) \cdot My^2\} \cdot C^4 - 2 \cdot My^2 \cdot Mx^2 \cdot (T4^2 + T2^2) \cdot C^2 + Mx^2 \cdot My^2 \cdot (Mx^2 + My^2) = 0 \tag{49}$$

By substituting $a = (T4^2 - T1^2) \cdot Mx^2 - (T2^2 - T1^2) \cdot My^2$ $b = My^2 \cdot Mx^2 \cdot (T4^2 + T2^2)$ $c = Mx^2 \cdot My^2 \cdot (Mx^2 + My^2)$ then, a quadratic equation $$a \cdot (C^2)^2 - 2 \cdot b \cdot (C^2) + c = 0 \tag{50}$$

is made.

Since $C^2 > 0$ and Ti>0, $$C^2 = \{b - (b^2 - a \cdot c)^{1/2}\}/a$$

and since C>0

$$C = [\{b - (b^2 - a \cdot c)^{1/2}\}/a[^{1/2}$$

The sound speed is not always calculable depending on the relationship between the position of the microphones and the ball collision point. For instance, if either one of the conditions ta1=ta2, ta1=ta4, ta3=ta2, and ta3=ta4 is satisfied, the denominator of the equation (48) 2·(t1–t2+t3–t4) becomes zero, where the calculation is impossible. In such case, the sound speed obtained just before is employed instead considering that the air temperatures do not change drastically. Since the temperature sensor method described before can always provide the sound speed C regardless of the collision point, the method is more advantageous in this aspect.

By calculating the sound speed C as above, and the values of Lt2, Lt4, and Lt0 with equations (31), (32), (38), and (39), and then substituting them in the equations (36) and (37), the coordinates (X,Y) of the collision point P can be calculated in the present embodiment. After calculating the collision point P (X,Y), the flying trajectory and the ground motion of the ball can be calculated as in the first embodiment.

Figure 14:
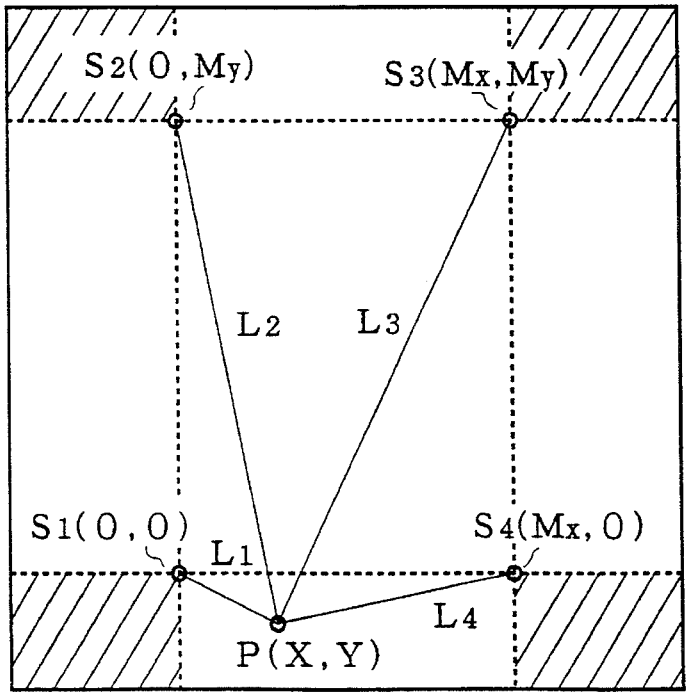
FIG. 14 is a schematic illustration showing a relationship between a collision point and points of microphones positioned when the collision point is out of the area formed by the four collision sound detecting microphones.

The description so far is based on an assumption that microphones are located at the four corners of the target sheet 12 as shown in FIG. 13, and the collision point P is within the rectangle of the four corners. The calculation of the collision point P is still possible even when the collision point P is out of the rectangle of the microphones as shown in FIG. 14.

As described above, there are two solutions of L0 which are given by the equations (38) and (39). When the collision point P is in the blank area of FIG. 14, the equation (38) gives one solution of L0 representing the collision point P. When the collision point P is in the hatched area of FIG. 14, the equation (39) gives the other solution of L0 representing the collision point P. Thus if one cannot know whether the collision point is within the rectangle or out of the rectangle, the collision point cannot be determined uniquely. Further, since three among the four values ta1, ta2, ta3, and ta4 of microphone data are sufficient for determining the collision point, four sets each consisting of three values can be used to calculate the collision point. In total, two solutions in each of the four calculations produce eight solutions of the collision point. Among the eight values of L0 are included four values representing the collision point P. Thus, when similar four values are found in the eight values, the value represents the actual collision point P.

Thus by using four microphones, the collision point P can be detected if the collision point is on the plane formed of the four microphones irrespective of within or out of the rectangle. Further, if more than five microphones are used, the calculation can be extended to the three-dimensional space.

The five microphone method for the three-dimensional positioning allows the detection of the ball hitting position and time without the microphone 105 at the hitting point (FIG. 1). Consequently, according to this method, the motion of a ball shot at an arbitrary point (i.e., not at a predetermined point) can be simulated. In this case, the microphones for detecting the collision point may be used. Instead, a microphone for detecting the hitting point may be provided independently.

Since the time length from the time point when a ball is shot to the time point when it arrives at the target screen is normally within a certain range, it is preferred to arrange so that no signal from the signal output from A/D converter 131 is written into the data memory 133 except the data coming within a certain time period after the signal from the shooting detection circuit 141 arrives at the data memory control circuit 134. This greatly reduces erroneous detections of the collision.

The calculation methods in the first and second embodiments described above are for illustrative purposes only, and other various calculation methods may be employed. For instance, the microphones are not necessarily fixed at the four corners of the target screen as shown in FIG. 1. They may be positioned at any arbitrary points such as of lozenge positions or other positions considering the space where the training apparatus is settled. In this case, the equations for obtaining the collision point P(X,Y) vary depending on the arrangement of microphones. However, once the collision point P(X,Y) is given from appropriate equations, the trajectory calculation can be performed in the same manner as the example described above.

In the calculations in the first and second embodiments, the air resistance against the ball 17 is neglected. In the approach shot, the distance of flight of the ball 17 is relatively short, the flight speed is not so large, and the mass of the ball 17 is large enough, so that the air resistance during the flight can be neglected. The change in flight motion caused by the spinning motion of the a ball 17 and the negative acceleration effect after landing are also disregarded in the calculations. When the ball 17 falls on a turf, a part of the kinetic energy is absorbed by the turf, and the bouncing height gradually decreases until finally the ball begins to roll. In rolling on the turf, the kinetic energy of the ball 17 is absorbed by the rolling resistance of the turf, and it finally stops in course of time. These spin effect, energy absorption in rebounding, rolling resistance and so on vary depending on the conditions of the ball 17 and the turf. But they can be regarded by the following method. First, the flight distance and the ground rolling distance of the ball 17 shot under representative conditions are measured, and representative values of various parameters (typical values) are predetermined in advance. Alternatively, by allowing the player to change the representative values in arbitrary manner, the calculation of the trajectories corresponding to various conditions can be achieved.

In consideration of the training apparatus used indoors, the frame 11 is preferred to be a pipe assembly type, and in addition, a net for setting between the target screen and shooting point is advised to use for safety, and metal fixtures to fix the net and frame 11 are preferred to be provided in a set.

The object collision point detecting apparatus according to the present invention can detect a point at which a flying object, such as a ball, collides against a predetermined target or the like, so as to utilize it for not only a training for golf, but also trainings for shooting and throwing in various games, and playing. For instance, it can be applicable to various trainings such as for batting and pitching in baseball, and for tennis, and for throwing in American football, and for shooting with a gun or the like. It may be possible to fix at least 3 oscillation detectors (microphones or the like), for instance, at an existing wall without providing a special target screen like the embodiment described above. When hitting time detecting means is provided, it can calculate not only the collision point but also the trajectory of the flying object such as a ball including the virtual trajectory after the collision, so trainings for various shots in golf, batting in base ball, tennis or the like can be effectively achieved. By providing for the apparatus additional functions such as input processes for various parameters and data process on the basis of the fundamental functions according to the invention, trainings and playing in various modes can be achieved to expand its applicable range.

What is claimed is:

1. An apparatus that detects a collision point of an object in a detection area, the apparatus comprising:

(a) at least three collision sound detecting devices located on a circumference of the detection area and out of alignment on a line;

(b) first calculating means for calculating the collision point in the detection area based on detection time points at which a collision sound of the object is detected by said at least three collision sound detecting devices, each of the detection time points being determined by digitizing an analog signal generated by each of the collision sound detecting devices into digital data and by processing the digital data;

(c) projection time detecting means for detecting a projection time point when the object is projected from a predetermined projection point; and (d) second calculating means for calculating a travelling time length of the object from the projection time point when the object is projected from the predetermined projection point to a time point when the object collides against the detection area, based on the detection time points determined by the first calculating means and the projection time point detected by the projection time detecting means, and for calculating a trajectory of the object until the object collides against the detection area and a virtual trajectory after the object collides against the detection area using the travelling time length and the collision point calculated by the first and second calculating means.

2. The collision point detecting apparatus according to claim 1, wherein the first calculating means calculates the collision point using a predetermined value of a sound speed.

3. The collision point detecting apparatus according to claim 1, further comprising:

(e) an ambient temperature measuring device that measures an ambient temperature; and (f) sound speed calculating means for calculating a sound speed based on the measured ambient temperature, the first calculating means calculating the collision point using the calculated sound speed and the detection time points at which the collision sound is detected by said at least three collision sound detecting means.

4. The collision point detecting apparatus according to claim 1, wherein four collision sound detecting devices are provided, and the first calculating means calculates the sound speed and the collision point based on the four detection time points each detected by one of the four collision sound detecting devices.

5. The collision point detecting apparatus according to claim 1, wherein:

four collision sound detecting devices, an ambient temperature measuring device that measures an ambient temperature, and sound speed calculating means for calculating a sound speed based on the measured ambient temperature are provided, and the first calculating means calculates four values of the collision point and determines the collision point by taking an average of the four values of the collision point.

6. The collision point detecting apparatus according to claim 5, wherein the first calculating means judges that the calculated collision point is abnormal when any difference between two values among the four values of the collision point is greater than a preset value.

7. A shot training apparatus comprising:

a) a target screen sheet stretched in a frame;

b) at least three collision sound detecting devices located on a circumference of said target screen sheet for detecting a sound of a collision of a flying object shot by a player on the target screen sheet;

c) first calculating means for calculating a collision point of the flying object on the target screen based on detection time points of the detections of the collision sound by said at least three collision sound detecting devices, each of the detection time points being determined by digitizing an analog signal generated by each of the collision sound detecting devices into digital data and by processing the digital data;

d) shooting time detecting means for detecting a shooting time point when the flying object is shot form a predetermined shooting point; and e) second calculating means for calculating a travelling time length of flying object from the shooting time point when the flying object is shot from the predetermined shooting point to a time point when the flying object collides against the target screen sheet, based on the detection time points determined by the first calculating means and the shooting time point detected by the shooting time detecting means, and for calculating a trajectory of the flying object until the flying object collides against the target screen sheet and a virtual trajectory after the object collides against the target screen sheet using the travelling time length and the collision point calculated by the first and second calculating means.

8. The shot training apparatus according to claim 7, wherein the first calculating means calculates the collision point using a predetermined value of a sound speed.

9. The shot training apparatus according to claim 8, further comprising:

an ambient temperature measuring device that measures an ambient temperature;

sound speed calculating means for calculating a sound speed based on the measured ambient temperature, the first calculating means calculating the collision point using the calculated sound speed and the detection time points at which the collision sound is detected by said at least three collision sound detecting devices.

10. The shot training apparatus according to claim 8, wherein four collision sound detecting devices are provided, and the first calculating means calculates the sound speed and the collision point based on the four detection time points each detected by one of the four collision sound detecting devices.

11. The shot training apparatus according to claim 8, further comprising:

an ambient temperature measuring device that measures an ambient temperature;

sound speed calculating means for calculating a sound speed based on the measured ambient temperature, wherein four collision sound detecting means, are provided, and the first calculating means calculates four values of the collision point and determines the collision point by taking an average of the four values.

12. The shot training apparatus according to claim 11, wherein the first calculating means judges that the calculated collision point is abnormal when any difference between two values among the four values of the collision point is greater than a preset value.

13. The shot training apparatus according to claim 8, wherein a target pattern with shooting scores is printed on the target screen sheet.

14. The shot training apparatus according to claim 8, wherein the flying object is a golf ball and the shooting time detecting means detects the hitting sound generated by a golf club and the golf ball.

15. The shot training apparatus according to claim 8, wherein the target screen sheet is extended from the bottom of the frame toward the shooting point so that the flying object returns to the shooting point after the flying object collides against the target screen sheet.

16. The shot training apparatus according to claim 7 further comprising display means for displaying results, such as the collision point of the flying object on the target screen sheet and the trajectory of the flying object, calculated by the first calculating means and the second calculating means.

* * * * *